US006989825B2

(12) United States Patent
Naito et al.

(10) Patent No.: US 6,989,825 B2
(45) Date of Patent: Jan. 24, 2006

(54) DISPLAY CONTROL DEVICE

(75) Inventors: Masahiro Naito, Tokyo (JP); Shuji Sotoda, Tokyo (JP); Takuji Kurashita, Tokyo (JP); Kazuhiro Sugiyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 295 days.

(21) Appl. No.: 09/851,348

(22) Filed: May 9, 2001

(65) Prior Publication Data

US 2001/0043206 A1 Nov. 22, 2001

(30) Foreign Application Priority Data

May 19, 2000 (JP) ..... 2000-147272

(51) Int. Cl.
*G09G 5/00* (2006.01)

(52) U.S. Cl. ..... 345/204; 345/571; 345/574

(58) Field of Classification Search ..... 345/87, 345/211, 212, 213, 204, 571–574
See application file for complete search history.

(56) References Cited

U.S. PATENT DOCUMENTS 5,408,247 A 4/1995 Enomoto et al.
5,736,981 A * 4/1998 Nobutani et al. ..... 345/185
5,838,291 A 11/1998 Ohshima et al.
5,914,699 A 6/1999 Imamura
6,014,133 A 1/2000 Yamakado et al.
6,043,803 A * 3/2000 Shimizu ..... 345/132
6,125,432 A * 9/2000 Hanami et al. ..... 711/157
6,233,658 B1 * 5/2001 Tamura ..... 711/150

(Continued)

FOREIGN PATENT DOCUMENTS

EP 0 613 115 A2 8/1994
EP 0726557 A1 8/1996
EP 01011087 A1 6/2000
WO WO00/02189 1/2000

OTHER PUBLICATIONS

Data Sheet PCF8548, "65×102 pixels matrix LCD driver", Product specification, Aug. 16, 1999, Philips Semiconductor, XP-002197924, pp. 1-39.

(Continued)

*Primary Examiner*—Alexander Eisen
*Assistant Examiner*—Kimnhung Nguyen
(74) *Attorney, Agent, or Firm*—Birch, Stewart, Kolasch & Birch, LLP

(57) ABSTRACT

In order to reduce the power consumed by the circuit when the image data is transferred to a memory in a display means, a write region detecting means 8 is provided to detect the address region in the graphics memory 2 accessed for writing by the image data writing means 1, and only such data that is within the region including the addresses accessed by the writing means 1 is transferred to the memory 5 in the display means 4. The region including the accessed addresses may for example a rectangular region of from the minimum vertical direction address to the maximum vertical direction address Y among the accessed addresses, and from the minimum horizontal direction address to the maximum horizontal direction address among the accessed addresses.

11 Claims, 11 Drawing Sheets

U.S. PATENT DOCUMENTS

| | | | | |
|---|---|---|---|---|
| 6,243,082 | B1 * | 6/2001 | Konishi | 345/204 |
| 6,295,053 | B1 * | 9/2001 | Tsai et al. | 345/204 |
| 6,300,964 | B1 * | 10/2001 | Intihar | 345/574 |
| 6,339,422 | B1 * | 1/2002 | Kuwajima et al. | 345/204 |
| 6,369,810 | B1 * | 4/2002 | Ijntema | 345/214 |
| 6,466,193 | B1 * | 10/2002 | Anai | 345/99 |
| 6,577,318 | B1 * | 6/2003 | Doi | 345/565 |

OTHER PUBLICATIONS

NEC Corporation, Preliminary Product Informatiion "*MOS Integrated Circuit μPD16683*." Document No. S13755EJ2V1PM00 (2nd edition), data published Dec. 1998 NS CP(K).

* cited by examiner

DISPLAY CONTROL DEVICE

BACKGROUND OF THE INVENTION

The present invention relates to a display control device, and in particular to a liquid crystal display control device for a portable equipment or the like.

FIG. 9 shows a display control device of a command control type. In FIG. 9, reference numeral 1 denotes an image data writing means including a CPU provided with an address bus, a data bus, and control lines. Reference numeral 2 denotes a graphics memory storing write data from the image data writing means 1. Reference numeral 3 denotes a data transfer means for reading, from the graphics memory 2, image data having been written by the image data writing means 1, and transferring the data to a display means 4. The display means 4 displays images, and includes a memory 5, a liquid crystal driver circuit 6 and a liquid crystal panel 7. The memory 5 stores image data for one screen of N dots (arranged in the horizontal direction)×M lines (arranged in the vertical direction) (N and M being positive integers) transferred from the data transfer means 3. The liquid crystal driver circuit 6 reads the data from the memory 5 responsive to clocks in synchronism with a display frequency, and drives the liquid crystal panel 7. The liquid crystal panel 7 is driven by the liquid crystal driver circuit 6 to display the image data.

In the display control device described above, as shown in FIG. 10, the image data for one screen is written from the image data writing means 1 such as a CPU or the like in the graphics memory 2. In this instance, not the entire screen of data is written, but only such part (pixels) of the screen of data that needs to be updated is rewritten. The data written represents images, characters, or the like. The image data in the graphics memory 2 is read by the data transfer means 3 sequentially from the address 0 to address N×(M-1). The data read is output to the display means 4, after addition of a command setting the horizontal address and the vertical address of the write region, e.g., a command as shown in FIG. 11. The display means 4 decodes the input command, and writes one screen of data in the region of from address 0 to address N×(M-1) in the memory 5. The data for one screen having been written in the memory 5 is read by the liquid crystal driver circuit 6 responsive to clocks in synchronism with the frame frequency of the liquid crystal display by the liquid crystal panel 7, and liquid crystal driving waveforms are thereby generated, and images are displayed by the liquid crystal panel 7.

Since the conventional display control device is configured as described above, when the data is transferred to the memory 5, one screen of data is transferred every time (every frame period). As a result, even when the data written from the image data writing means 1 to the graphics memory 2 is updated with regard to a small area of the screen, the transfer means 3 transfers the entire screen of data from the graphics memory 2 to the memory 5. The amount of power consumption of the circuit operating for the data transfer is the same as that required for rewriting the entire screen, so that the efficiency is low, and the useless power consumption occurs.

SUMMARY OF THE INVENTION

The invention has been made to solve the problems described above, and its object is to reduce the power consumption required by the circuit for transferring image data to the memory of a display means.

According to the present invention, there is provided a display control device including an image data writing means, a graphics memory connected to the writing means, a data transfer means responsive to a command from the writing means for reading data from the graphics memory, and transferring data to a display means, and a write region detection means responsive to addresses accessed by the image data writing means for detecting a region including all the addresses, wherein when the image data writing means issues a transfer command, said transfer means transfers to the display means only such data that is in the region detected by said write region detecting means.

With the above arrangement, it is possible to reduce the amount of data that is transferred, so that the power consumed by the circuit when the data transfer means transfers the image data to the display means.

The region detecting means may be adapted to detect, as said write region, the region from the minimum vertical direction address and the maximum vertical direction address among the addresses accessed by said image writing means.

With the above arrangement, the extent of the write region is defined in a simple manner, so that it is possible to simplify the configuration of the circuit of the write region detecting means, and the power consumed by the write region detecting means can be reduced.

The region detecting means may be adapted to detect, as said write region, the region from the minimum vertical direction address to the maximum vertical direction address among the addresses accessed by said image writing means, and from the minimum horizontal direction address to the maximum horizontal direction address among the addresses accessed by said image writing means.

With the above arrangement, the amount of data transferred can be further reduced, so that the power consumed by the circuit when the data transfer means transfers the image data to the display means can be further reduced.

The region detecting means may alternatively be adapted to detect, as said write region, a rectangular region from the minimum vertical direction address to the maximum vertical direction address among the addresses accessed by said image writing means, and from a minimum horizontal direction address to the maximum horizontal direction address of a screen.

With the above arrangement, the amount of power consumed by the circuit when the data transfer means transfers the image data to the display means is reduced. Moreover, the circuit configuration of the write region detecting means is simplified, so that the power consumed by the circuit when the write addresses are detected can be reduced.

DETAILED DESCRIPTION OF THE EMBODIMENTS

Embodiments of the invention will now be described with reference to the drawings.

Embodiment 1

Figure 1:
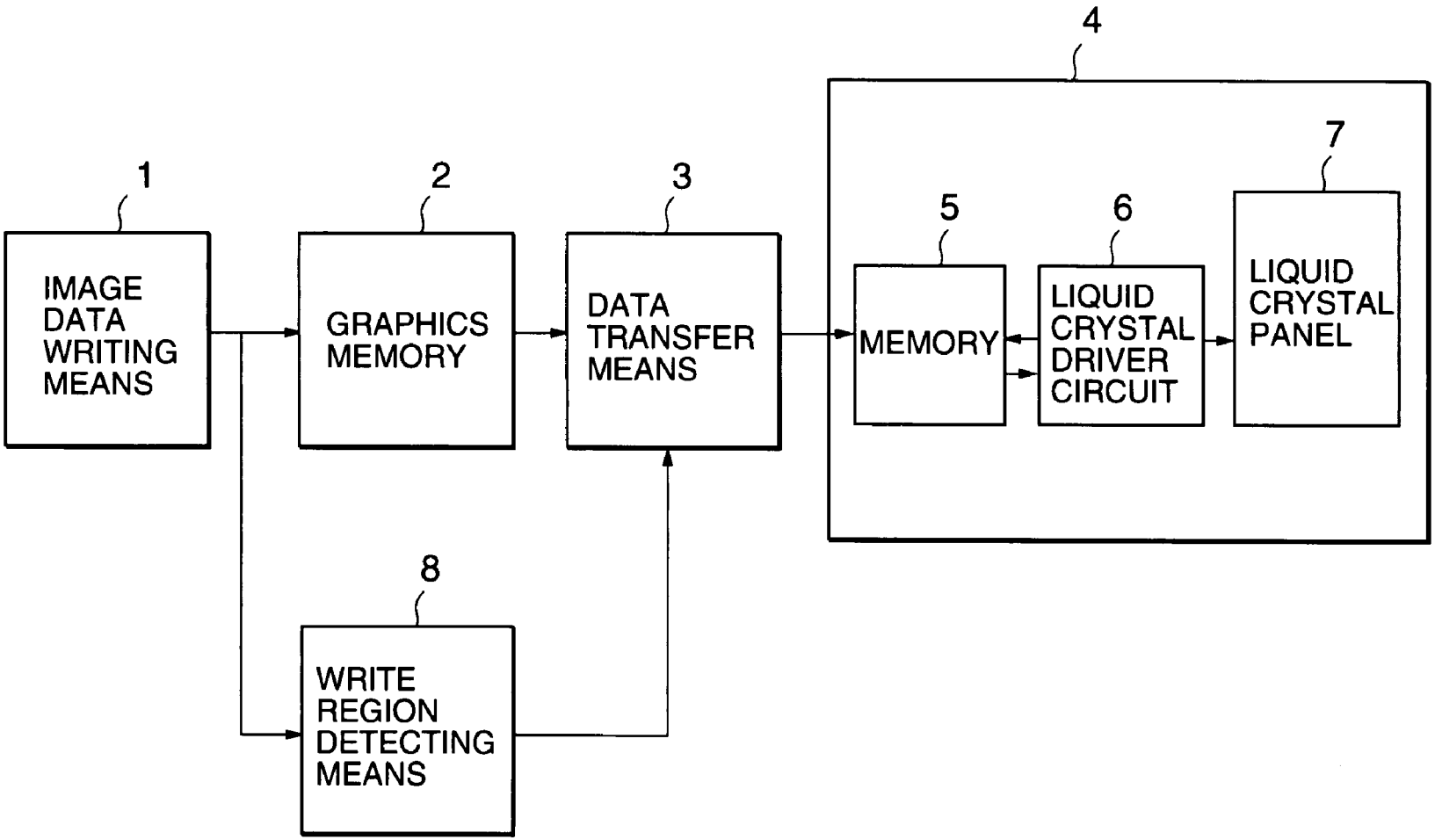
FIG. 1 is a block diagram showing a display control device of Embodiment 1 of the present invention.

FIG. 1 shows a display control device of Embodiment 1 of the invention. In the drawing, reference numeral 1 denotes an image data writing means including a CPU provided with an address bus, a data bus, and control lines. Reference numeral 2 denotes a graphics memory which stores write data from the image data writing means 1, and is formed of N dots (arranged in the horizontal direction) by M lines. Reference numeral 3 denotes a data transfer means for reading image data from the graphics memory 2 in accordance with region information from write region detecting means 8, and transferring the data to a display means 4. Reference numeral 8 denotes a write region detecting means which detects the addresses accessed when the image data writing means 1 writes the data in the graphic memory 2, and outputs the region information thus detected, to the the data transfer means 3.

The display means 4 includes a memory 5, a liquid crystal driver circuit 6 and a liquid crystal panel 7. The memory 5 stores image data transferred from the data transfer means 3. The liquid crystal driver circuit 6 reads the data from the memory 5 responsive to clocks in synchronism with the display frequency, and drives the liquid crystal panel 7. The liquid crystal panel 7 is driven by the liquid crystal driver circuit 6 to display the image.

In the display control device configured as described above, image data formed of an arbitrary number of dots is written from the image data writing means 1 such as a CPU or the like, in the graphics memory 2. Rather than the entire screen of data, such data of only a part (pixels) that need to be updated is re-written. The write region detecting means 8 receives the signals sent over the address bus and control signal lines from the image data writing means 1, and detects the addresses in the graphics memory 2 in which the data is to be written.

Figure 2:
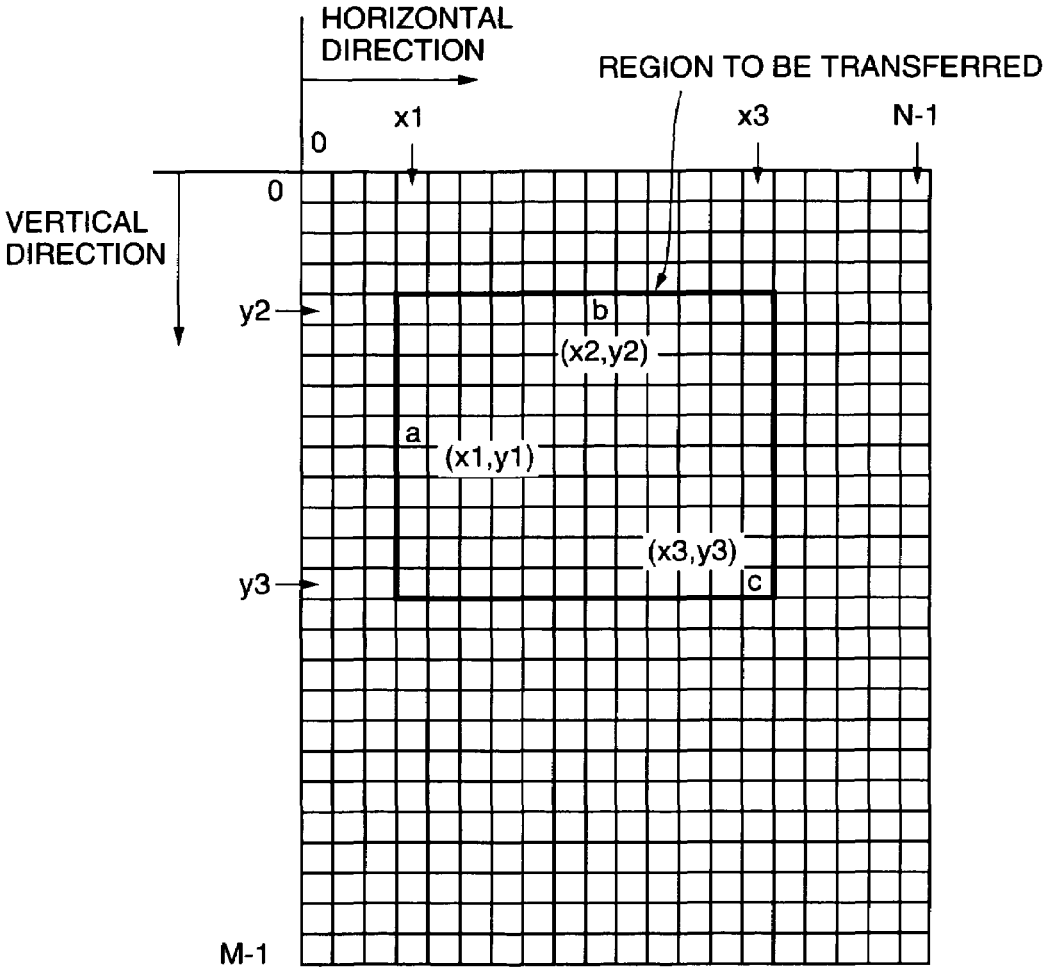
FIG. 2 is a diagram showing an example of write addresses for the graphics memory in Embodiment 1 of the present invention.

The operation of the write region detecting means 8 will next be described. It is assumed that in a certain frame period, data a, b and c are written at the addresses (x1, y1), (x2, y2) and (x3, y3), respectively, in the graphics memory 2, as shown in FIG. 2. Here, x1, x2, x3, y1, y2, and y3 are positive integers, and are related as follows:

$$x1<x2<x3, \text{ and}$$

$$y2<y1<y3.$$

Figure 3:
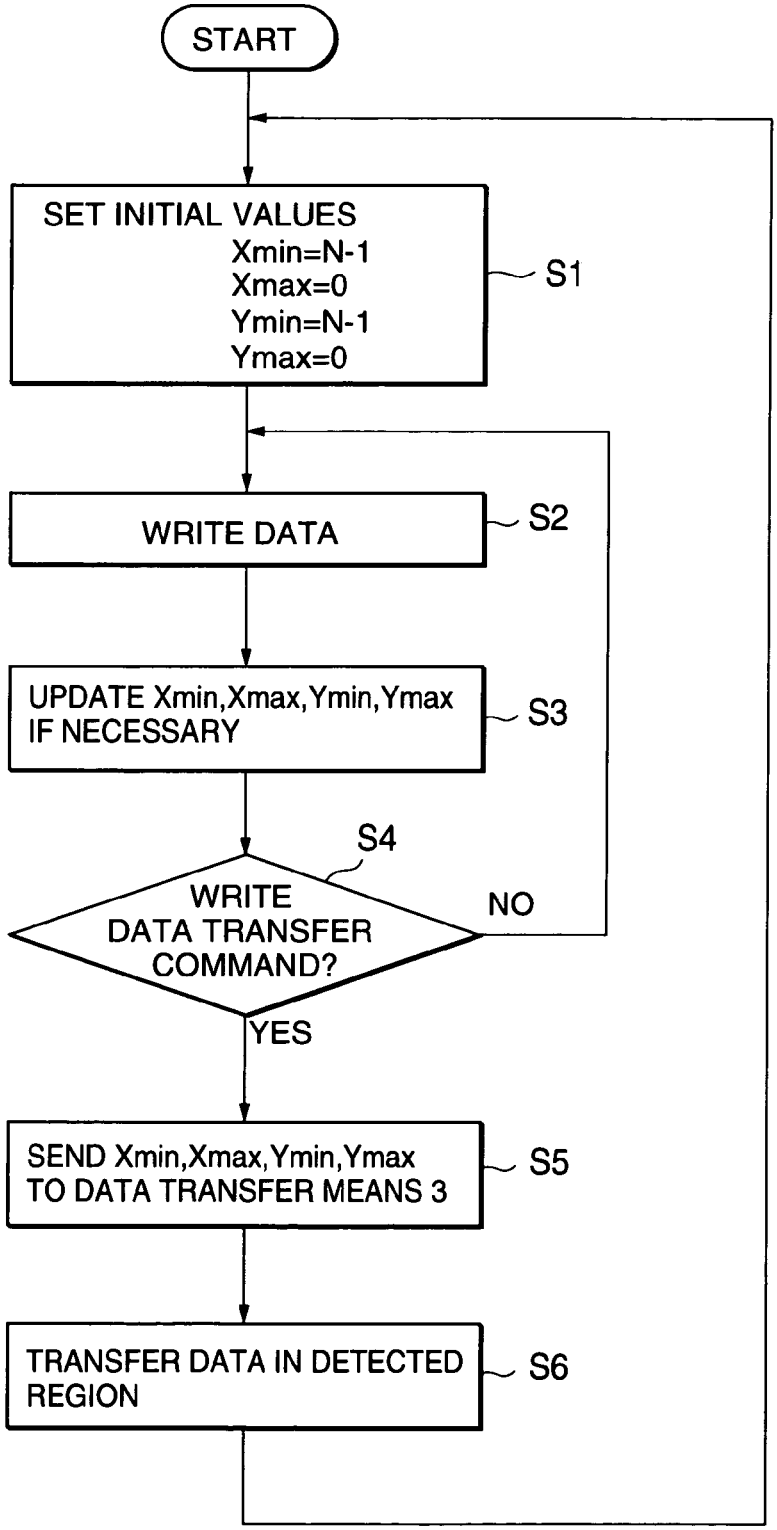
FIG. 3 is a diagram showing the procedure of write region detection and subsequent data transfer in Embodiment 1 of the present invention.

Moreover, a, b and c represent image or character data, and are for example positive values representing R, G and B data. Furthermore, the horizontal direction minimum value among the detected addresses (minimum horizontal direction address) is represented by Xmin, the horizontal direction maximum value among the detected addresses (maximum horizontal direction address) is represented by Xmax, the vertical direction minimum value among the detected addresses (minimum horizontal direction address) is represented by Ymin, and the vertical direction maximum value among the detected addresses (maximum vertical direction address) is represented by Ymax. The procedure for finding the values of Xmin, Xmax, Ymin and Ymax is shown in FIG. 3.

First, the initial values of Xmin, Xmax, Ymin and Ymax are set such that Xmin=N-1, Xmax=0, Ymin=M-1, and Ymax= 0 (S1). Next, when writing in the graphic memory 2 by means of the image data writing means 1 is performed (S2), the write region detecting means 8 compares the write addresses in accordance with the signals supplied via the address bus and the control signal lines, and performs updating if necessary (S3). This operation is continued until the image data writing means 1 issues a data transfer command (S4). As a result of the above operations, the four coordinate values Xmin=x1, Xmax=x3, Ymin=y2, and Ymax=y3 are detected (such a case is assumed) immediately before the data transfer command is issued.

When the data transfer command is issued from the image data writing means 1, the write region detecting means 8 outputs the detected addresses Xmin=x1, Xmax=x3, Ymin=y2, and Ymax=y3 to the data transfer means 3 (S5). After outputting the detected addresses, the write region detecting means 8 sets the detected addresses to initial values in order to detect the write region of image data for the next screen (frame), and repeats the operation similar to that described above.

Figure 4:
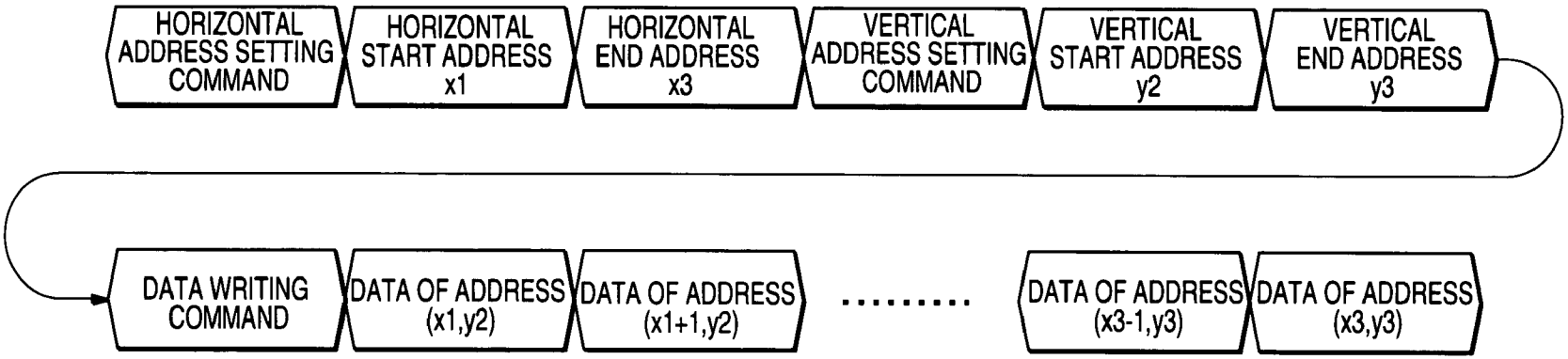
FIG. 4 is a diagram showing the manner of data transfer to the display means in Embodiment 1 of the present invention.

When the data transfer means 3 receives the detected addresses Xmin=x1, Xmax=x3, Ymin=y2, and Ymax=y3 from the write region detecting means 8, it transfers the image data within the rectangular region defined by the detected addresses, to the memory 5 (S6). That is, it generates a command setting the write region, as shown in FIG. 4, reads the image data in the rectangular region surrounded by (x1, y2), (x3, y2), (x1, y3) and (x3, y3), and outputs the read image data following the command setting the write region.

The display means 4 decodes the input command, and writes the data read from the graphics memory 2 in the rectangular region in the memory 5 defined by (x1, y2), (x3, y2), (x1, y3) and (x3, y3). When the transfer of data within the detected region is completed, it waits for the next data transfer command, and repeats the operation similar to that described above.

The data rewritten partially in the memory 5, together with the data in the other region already in the memory 5 is read, as data for one screen, by the liquid crystal driver circuit 6 responsive to the clocks in synchronism with the frame frequency of the liquid crystal display of the liquid crystal panel 7, and the liquid crystal driver circuit generates liquid crystal driving waveforms, causing the liquid crystal panel to display.

As has been described, by means of the write region detecting means 8 which detects the region in the graphics memory 2 accessed for writing by the image data writing means 1, the rectangular region of from the minimum vertical direction address Ymin to the maximum vertical direction address Ymax among the addresses accessed by the image data writing means 1, and from the minimum horizontal direction address Xmin to the maximum horizontal direction address Xmax among the addresses accessed by the image data writing means 1 is detected as the write region, and the data transfer means 3 is responsive to the detected region information for transferring only such data that have been rewritten, to the display means 4. For this reason, it is possible to reduce the power consumed by the circuit when the data transfer means 3 transfers the image data to the memory 5 in the display means 4.

Embodiment 2

Figure 5:
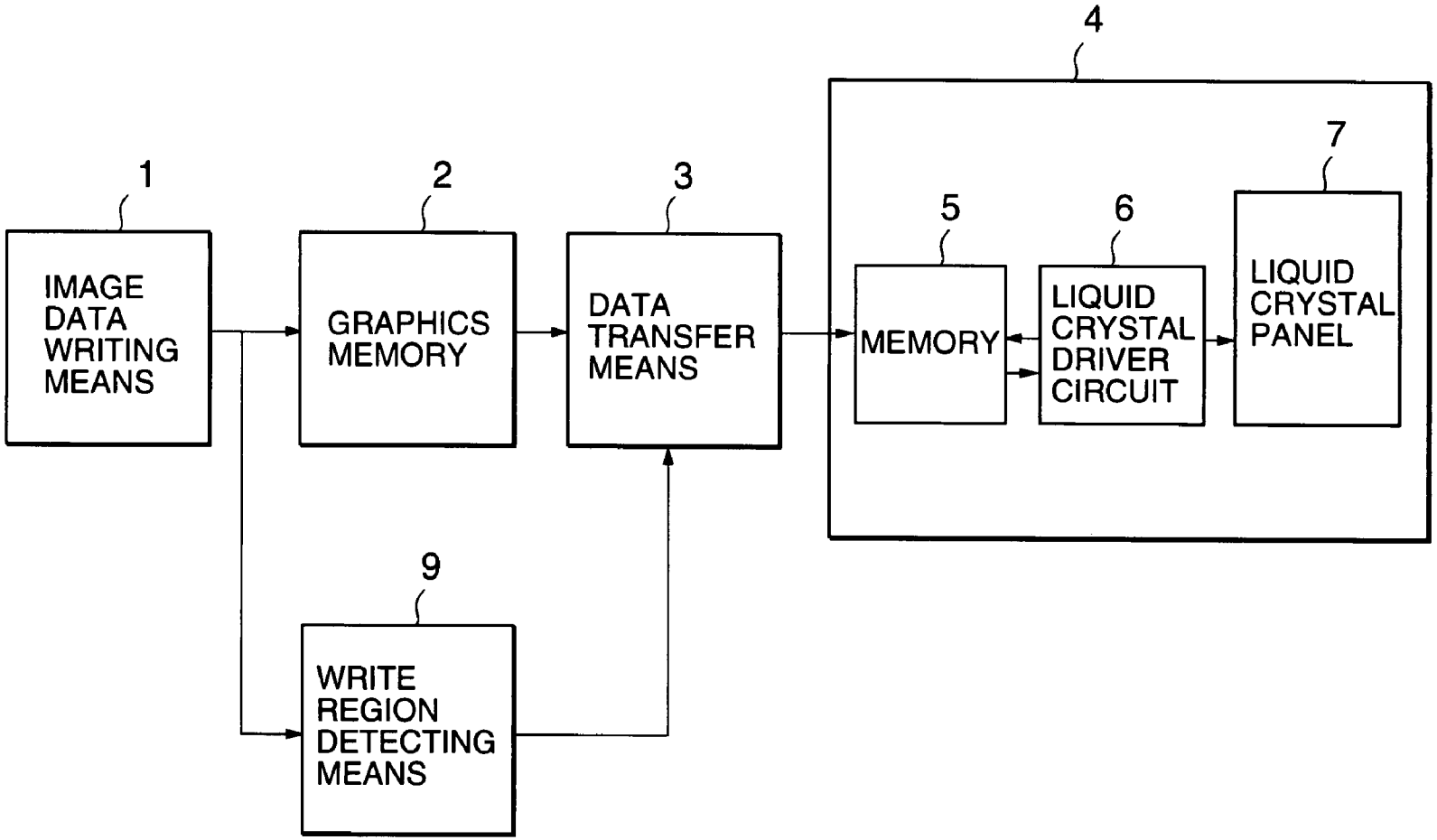
FIG. 5 is a block diagram showing a display control device of Embodiment 2 of the present invention.

FIG. 5 shows a display control device of Embodiment 2 of the present invention. The display control device of Embodiment 2 is similar to the display control device of FIG. 1, but is provided with a write region detecting means 9 in place of the write region detecting means 8 of FIG. 1. Whereas the write region detecting means 8 of FIG. 1 detects, as the write region, a rectangular region from the minimum vertical direction address Ymin to the maximum vertical direction address Ymax among the addresses accessed by the image data writing means 1, and from the minimum horizontal direction address Xmin to the maximum horizontal direction address Xmax among the addresses accessed by the image data writing means 1, the write region detecting means 9 of FIG. 5 detects, as the write region, a rectangular region from the minimum vertical direction address Ymin to the maximum vertical direction address Ymax among the addresses accessed by the image data writing means 1, and from the minimum horizontal direction address 0 and the maximum horizontal direction address (N-1) among the addresses of the screen. In other words, it detects, as the write region, a plurality of consecutive lines. Since the minimum horizontal direction address 0 to the maximum horizontal direction address (N-1) among the addresses of the screen are known in advance, the write region detecting means 9 detects only the minimum vertical direction address Ymin and the maximum vertical direction address Ymax.

Figure 6:
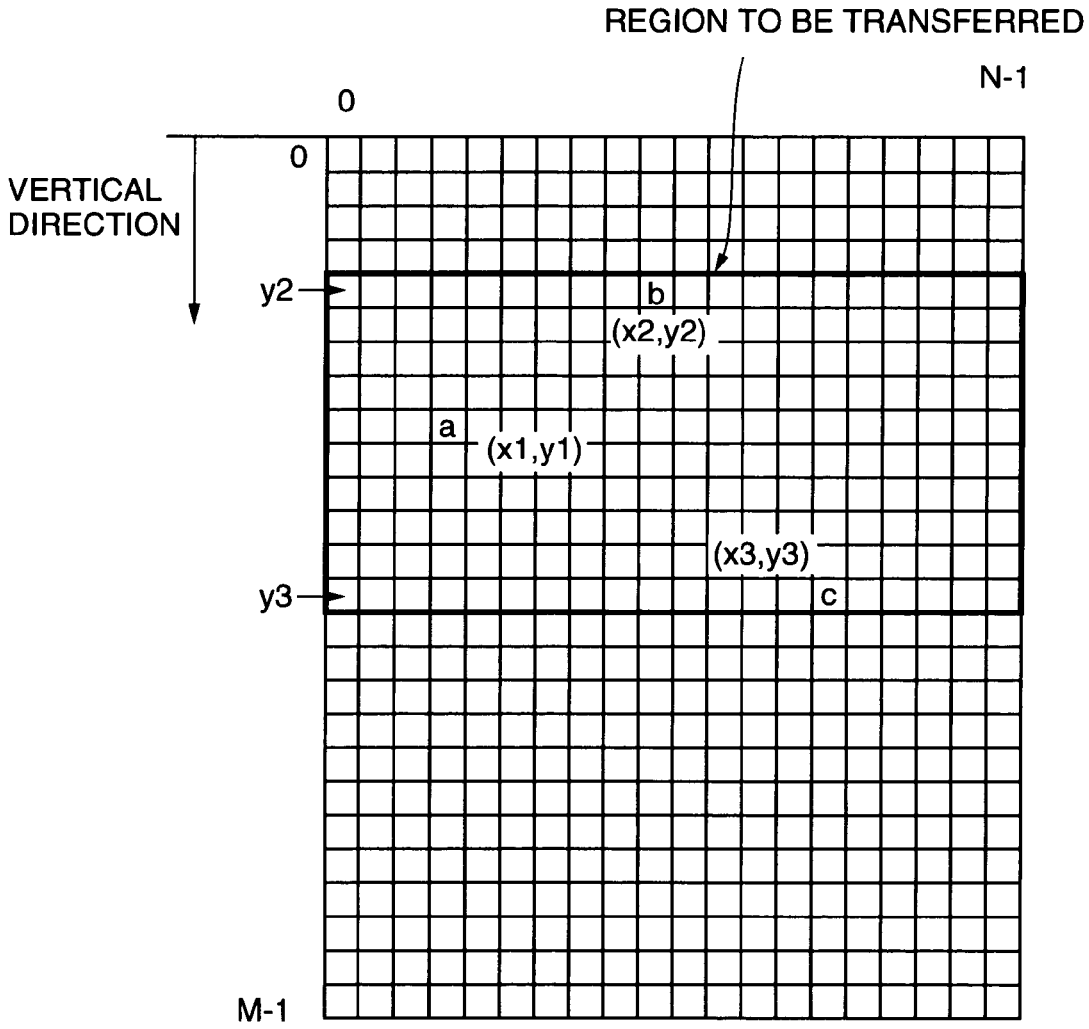
FIG. 6 is a diagram showing an example of write addresses for the graphics memory in Embodiment 2 of the present invention.

The operation of the write region detecting means 9 will next be described. For instance, it is assumed that, in a certain frame period, data a, b, and c are respectively written in the addresses (x1, y1), (x2, y2), (x3, y3) in the graphics memory 2 as shown in FIG. 6, as in Embodiment 1. Also as in Embodiment 1, x1, x2, x3, y1, y2, and y3 are positive integers, and related as follows:

$$x1<x2<x3, \text{ and}$$

$$y2<y1<y3.$$

Figure 7:
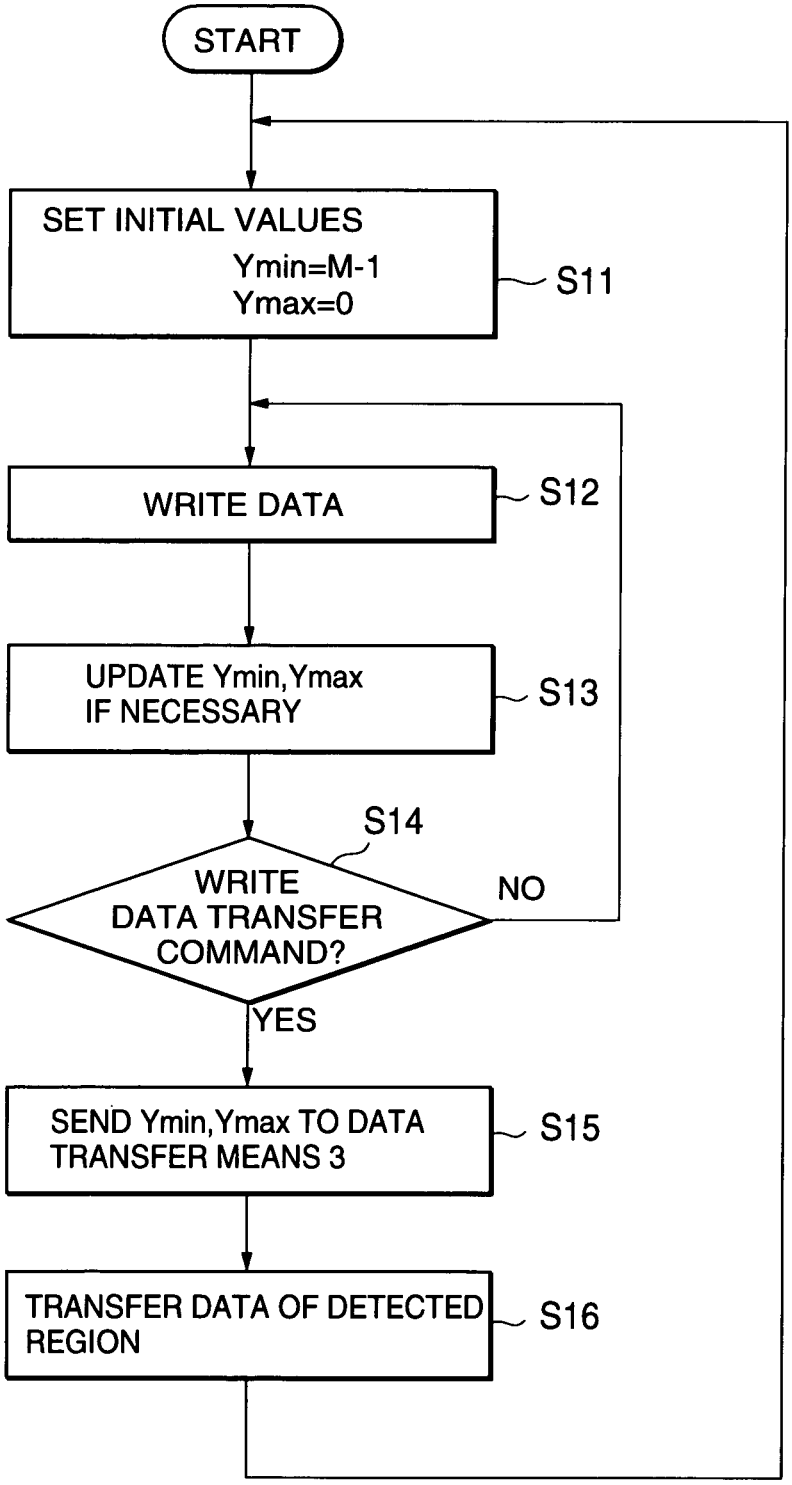
FIG. 7 is a diagram showing the procedure of write region detection and subsequent data transfer in Embodiment 2 of the present invention.

Moreover, a, b, and c represent image or character data, and are for example positive values representing R, G and B data. Furthermore, the vertical direction minimum value (minimum vertical direction address) and the vertical direction maximum value (maximum vertical direction address) among the detected addresses are respectively denoted by Ymin and Ymax. The procedure for finding Ymin and Ymax is shown in FIG. 7.

First, the initial values of Ymin and Ymax are set such that Ymin=M-1, and Ymax=0 (S11). Next, when writing in the graphic memory 2 by means of the image data writing means 1 is performed (S12), the write region detecting means 9 compares the write addresses in accordance with the signals supplied via the address bus and the control signal lines, and performs updating if necessary (S13). This operation is continued until the image data writing means 1 issues a data transfer command (S14). As a result of the above operations the two coordinate values Ymin=y2, and Ymax=y3 are detected (such a case is assumed) immediately before the data transfer command is issued.

When the data transfer command is issued from the image data writing means 1, the write region detecting means 9 outputs the detected addresses Ymin=y2, and Ymax=y3 to the data transfer means 3 (S15). After outputting the detected addresses, the write region detecting means 9 sets the detected addresses to initial values in order to detect the write region of image data for the next screen (frame), and repeats the operation similar to that described above.

Figure 8:
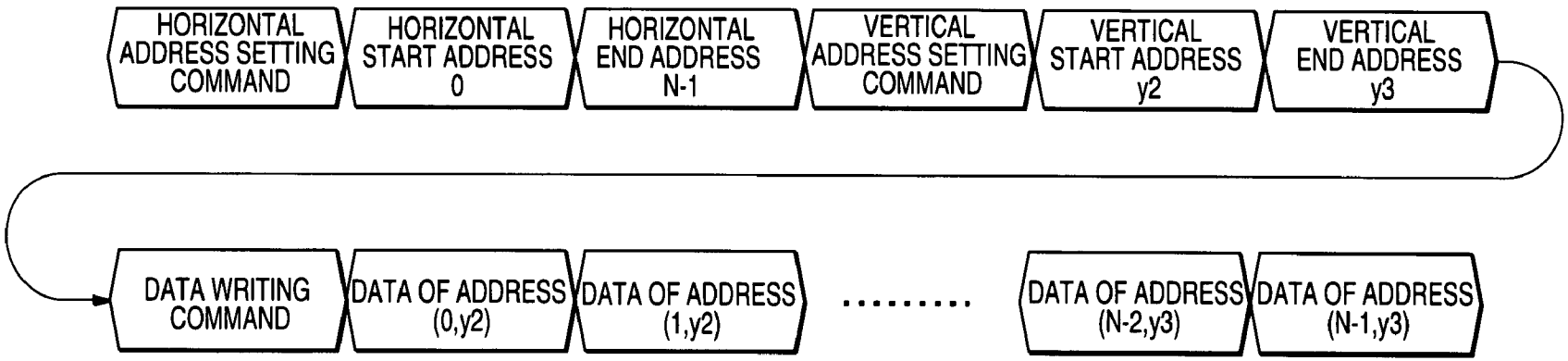
FIG. 8 is a diagram showing the manner of data transfer to the display means in Embodiment 2 of the present invention.
Figure 9:
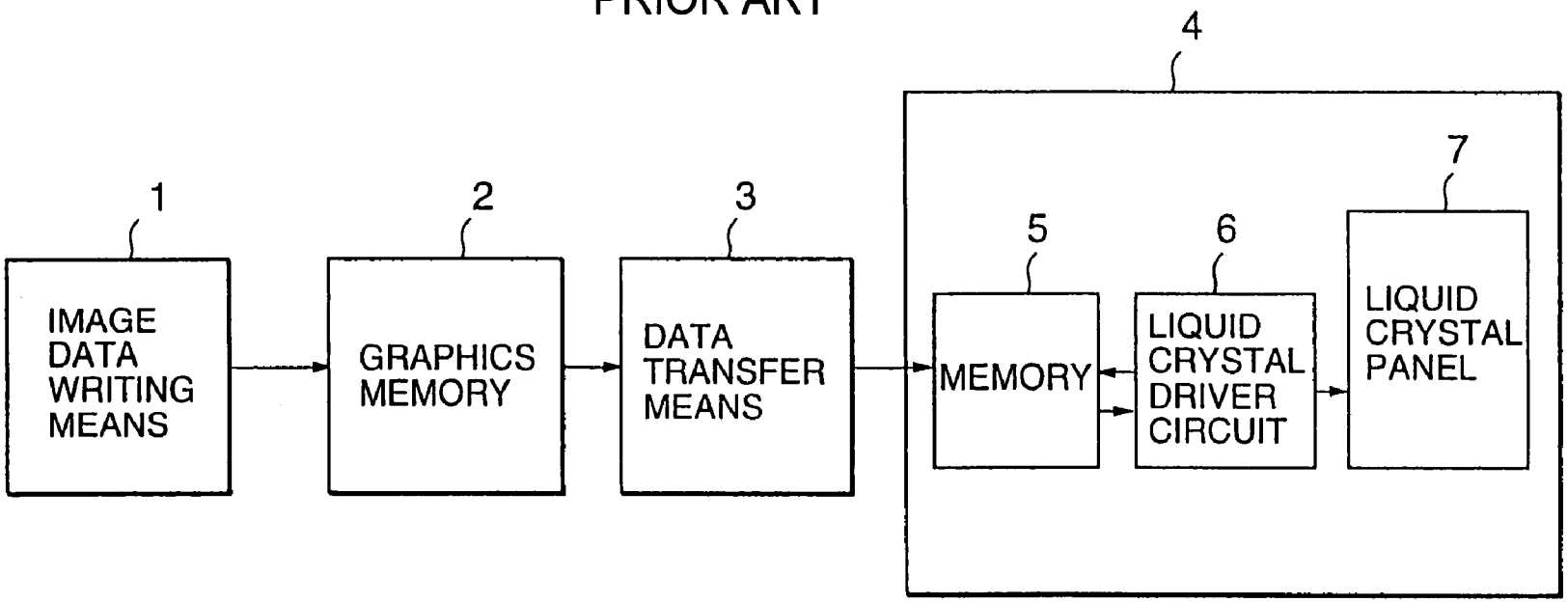
FIG.9 PRIOR ART
FIG. 9 is a block diagram showing the configuration of a conventional display control device.
Figure 10:
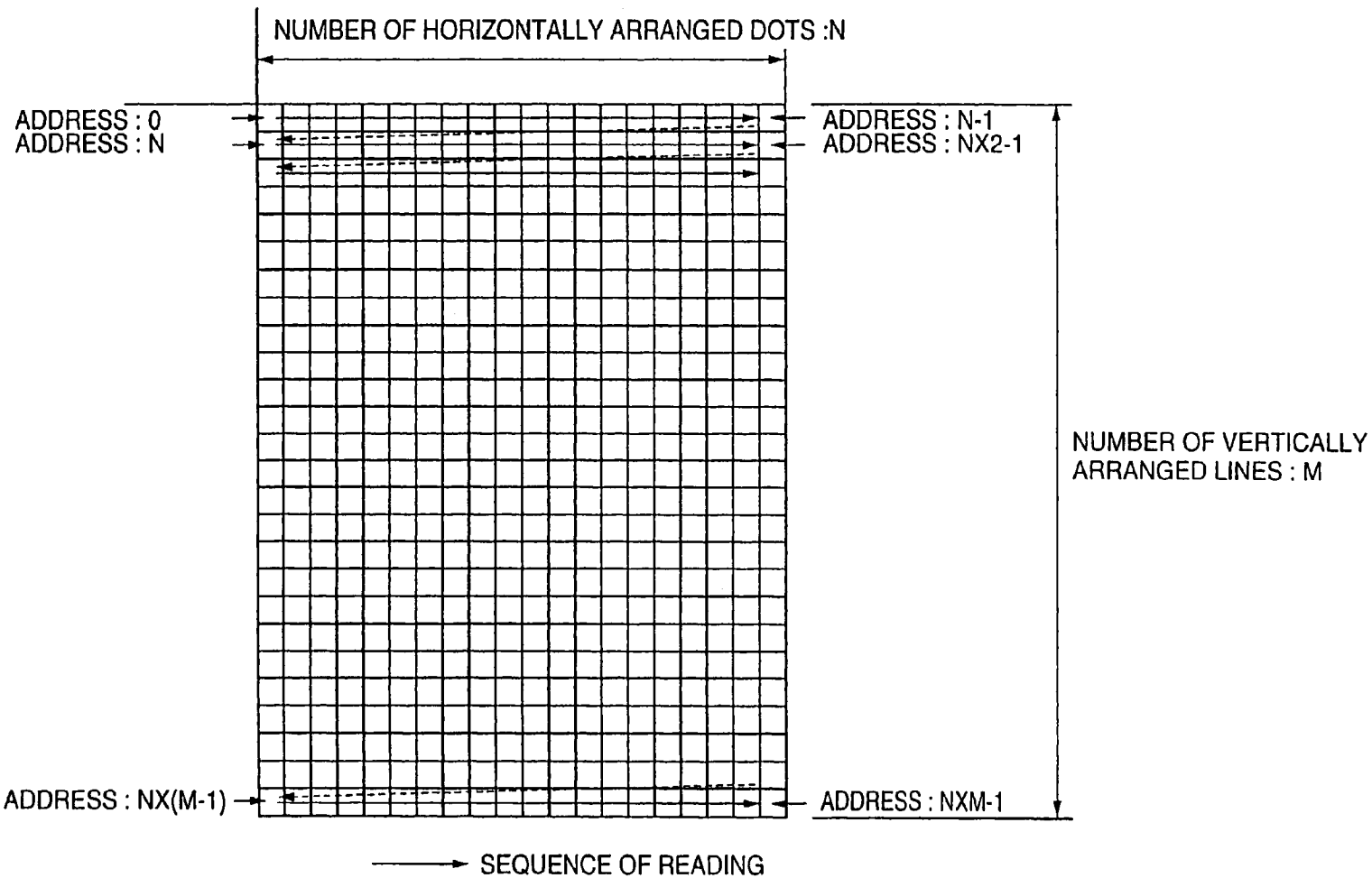
FIG.10 PRIOR ART
FIG. 10 is a diagram showing the configuration of a graphics memory in a conventional display control device, and the manner of reading.
Figure 11:
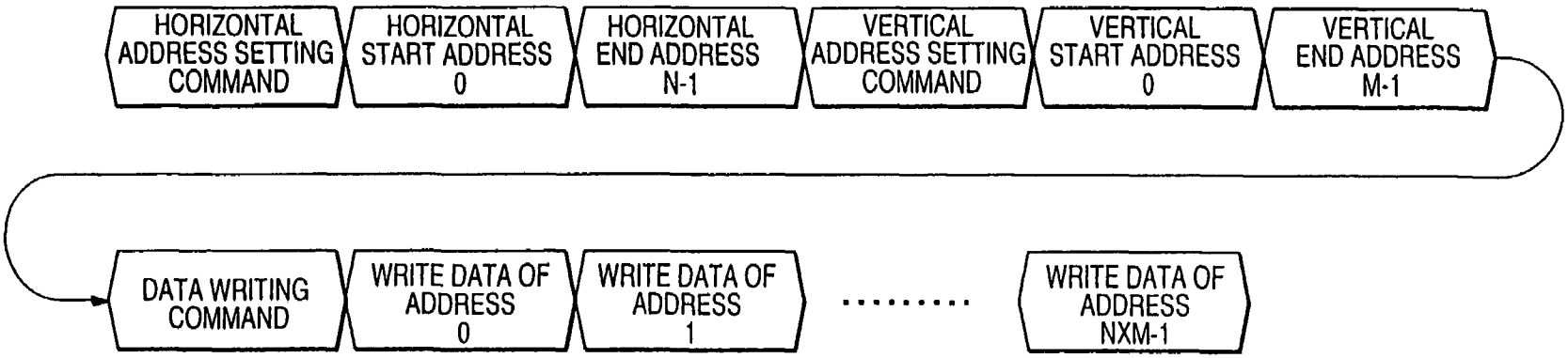
FIG.11 PRIOR ART
FIG. 11 is a diagram showing the manner of data transfer to the display means in the conventional display control device.

When the data transfer means 3 receives the detected addresses Ymin=y2, and Ymax=y3 from the write region detecting means 9, it transfers the image data within the rectangular region formed of the plurality of lines defined by the detected addresses, to the memory 5 (S16). That is, it generates a command setting the write region, as shown in FIG. 8, reads the image data of the plurality of lines of from the line of address y2 to the line of address y3, i.e., the image data within the rectangular region surrounded by (0, y2), (N-1, y2), (0, y3) and (N-1, y3), and outputs the read image data following the command setting the write region.

The display means 4 decodes the input command, and writes the data read from the graphics memory 2 in the region in the memory 5 of from the vertical direction address y2 to y3. When the transfer of data within the detected region is completed, it waits for the next data transfer command, and repeats the operation similar to that described above. In other respects, the operation is similar to Embodiment 1.

As has been described, by means of the write region detecting means 9 which detects the region in the graphics memory 2 in which the image data writing means 1 writes, the rectangular region of from the minimum vertical direction address Ymin to the maximum vertical direction address Ymax among the addresses accessed by the image data writing means 1, and of from the minimum horizontal direction address 0 to the maximum horizontal direction address (N-1) among the addresses of the screen is detected as the write region, and the data transfer means 3 is responsive to the detected region information for transferring only such data that have been rewritten, to the display means 4. For this reason, it is possible to reduce the power consumed by the circuit when the data transfer means 3 transfers the image data to the memory 5 in the display means 4. Moreover, the write region detecting means 9, which detects the accessed region, needs to compare only the vertical direction addresses of the write addresses to detects only the two vertical direction addresses, i.e., the vertical direction minimum value Ymin and the vertical direction maximum value Ymax, so that the configuration of the circuit is simplified and the power consumed by the circuit when the write addresses are detected can be reduced.

What is claimed is:

1. A display control device including an image data writing means, a graphics memory connected to the writing means, a data transfer means responsive to a command from the writing means for reading data from the graphics memory, and transferring data to a display means having a memory, and a write region detection means responsive to addresses for arbitrary image data accessed by the image data writing means for detecting a region to be updated including all the addresses being accessed, wherein when the image data writing means issues a transfer command, said transfer means transfers to the display means only such data that is in the region to be updated of said arbitrary image data detected by said write region detecting means, and wherein the arbitrary image data to be updated is rewritten partially in the memory of the display means, and together with the data in the other region already in the memory of the display means, are read as data for one screen.

2. The display control device as set forth in claim 1, wherein said region detecting means detects, as said write region, the region from the minimum vertical direction addresses and the maximum vertical direction address among the addresses accessed by said image writing means.

3. The display control means as set forth in claim 2, wherein said region detecting means detects, as said write region, the region from the minimum vertical direction address to the maximum vertical direction address among the addresses accessed by said image writing means, and from the minimum horizontal direction address to the maximum horizontal direction address among the addresses accessed by said image writing means.

4. The display control device as set forth in claim 2, wherein said region detecting means detects, as said write region, a rectangular region from the minimum vertical direction address to the maximum vertical direction address among the addresses accessed by said image writing means, and from a minimum horizontal direction address to the maximum horizontal address.

5. The display control device as set forth in claim 1, wherein:

said graphics memory stores data from the image data writing means at an address designated by the image data writing means, said image data writing means writes data of only such part that needs to be updated, in said graphics memory, and said write region detection means is responsive to signals, including said transfer command, representing the addresses accessed by the image data writing means for detecting the region including all the addresses.

6. A machine-readable medium having stored thereon a plurality of executable instructions, the plurality of instructions comprising instructions to:

write arbitrary image data to addresses within a graphics memory using an image data writing means;

read and transfer said arbitrary image data, using a transfer means and a write region detection means, from the graphics memory to a display means having a memory in response to a transfer command issued from the image data writing means;

wherein said write region detection means, responsive to said addresses accessed by the image data writing means, to detect a region to be updated including all said addresses for the arbitrary image data being accessed;

wherein said transfer means, responsive to said transfer command issued from the image data writing means, to transfer to said display means only such data in the region of arbitrary image data detected by said write region detection means;

store data, using said graphic memory, from the image data writing means at an address designated by the image data writing means, write data, using said image data writing means, of only such part that needs to be updated in said graphics memory; and wherein said write region detection means is responsive to signals, including said transfer command, representing the addresses of arbitrary image data accessed by the image data writing means for detecting the region including all the addresses, and wherein the arbitrary image data to be undated is rewritten partially in the memory of the display means, and together with the data in the other region already in the the memory of the display means, are read as data for one screen.

7. A machine-readable medium having stored thereon a plurality of executable instructions, the plurality of instructions comprising instructions to:

access arbitrary image data using addresses within a memory for transfer to a display device having a memory;

determine an image data region to be updated, being less than a full display screen of image data, including said addresses of arbitrary image; and transfer said arbitrary image data within said image data region to said display device, and wherein the arbitrary image data to be updated is rewritten partially in the memory of the display means, and together with the data in the other region already in the memory of the display means, are read as data for one screen.

8. The medium of claim 7, wherein said image data region includes a region from a minimum vertical direction address to a maximum vertical direction address among said addresses being accessed.

9. The medium of claim 8, wherein said image data region includes a region from a minimum horizontal direction address to a maximum horizontal direction address among said addresses being accessed.

10. The medium of claim 8, wherein said image data region includes a substantially rectangular region from minimum vertical and horizontal direction addresses to maximum vertical and horizontal direction addresses among said addresses being accessed.

11. The display control device as set forth in claim 1, wherein said write region detection means detects minimum and maximum addresses among addresses within the graphics memory that have been accessed by said image data writing means, for detecting said region.

* * * * *